US005738067A

United States Patent [19]

Landwehr et al.

[11] Patent Number: 5,738,067

[45] Date of Patent: Apr. 14, 1998

[54] COSMETICS CONTAINER

[75] Inventors: Josef Landwehr, Lohne, Germany; Melvin Edwin Kamen, Highlands, N.J.

[73] Assignee: Revlon Consumer Products Corporation, New York, N.Y.

[21] Appl. No.: 737,453

[22] PCT Filed: May 16, 1995

[86] PCT No.: PCT/EP95/01838

§ 371 Date: Feb. 21, 1997

§ 102(e) Date: Feb. 21, 1997

[87] PCT Pub. No.: WO95/31121

PCT Pub. Date: Nov. 23, 1995

[30] Foreign Application Priority Data

May 16, 1994 [DE] Germany ..... 9407891.2 U

[51] Int. Cl.[6] ..... A45D 40/26

[52] U.S. Cl. ..... 132/320; 132/318; 132/317; 401/116; 222/167; 222/192; 206/446

[58] Field of Search ..... 132/320, 318, 132/317; 401/78, 116, 125; 222/167, 182, 160, 131, 192; 206/446, 525, 385

[56] References Cited

U.S. PATENT DOCUMENTS 3,825,021 7/1974 Seidler ..... 132/320

4,640,637 2/1987 Winthrop ..... 401/116

5,180,084 1/1993 Favre ..... 132/317

5,499,474 3/1996 Quennessen ..... 132/320

*Primary Examiner*—John J. Wilson

*Assistant Examiner*—Pedro Philogene

*Attorney, Agent, or Firm*—Hill & Simpson

[57] ABSTRACT

A cosmetics container is provided having a housing (1) which is coverable by a cap (2). The housing protectively contains a cosmetic or medicinal preparation such as a lipstick or ointment which can be extruded for application to the skin. In solid lipsticks, problems often arise as a result their temperature-dependent characteristics. To avoid such problems, the container of the invention is for use with a pumpable fluid preparation in the form of a paste or viscous liquid. The container acts as a dispenser, having a push-button actuator (10, 20') operable to pump the preparation in a skin contact element (31) with an applicator surface (32) and a dispensing valve (33). In a particularly useful embodiment, the skin applicator surface (31) is arranged in a plane which is inclined in relation to a longitudinal axis (x—x) of the housing (1).

15 Claims, 2 Drawing Sheets

COSMETICS CONTAINER

BACKGROUND OF THE INVENTION

The invention is directed to a cosmetics container comprising a generally cylindrical, oval or rectangular housing coverable with a cap, the housing being configured to accommodate and protect a cosmetic or therapeutic preparation that can be dispensed and applied to the skin.

Commercially available containers for cosmetics, lipsticks, anti-perspirants, deodorants or the like contain a sleeve that is generally cylindrically fashioned and held in a housing. The content of the cosmetics container is usually adjustably dispensed by a screw mechanism screwing motion. In conventional lipstick containers, the sleeve with the shape-stable content is fashioned telescopically extensible and retractable with a screwing motion. The shape-stable cosmetic stick is usually manufactured of waxes and oils with the addition of mineral colors or organic pigments, for example eosin. In one form, the cosmetics stick is formulated to color and adhere smear-proof to the uppermost skin layers of the lips without damaging health. On a case by case basis, cosmetics containers are also provided with effective substances for therapeutic purposes that are applied, for example, to dry, cracking or chapped lips which sometimes results from strong exposure to the sun.

Unfortunately, such conventional shape-stable cosmetics are disadvantageous because they are temperature-sensitive. Specifically, they can become soft under warm summer temperatures, thereby tend to break off, or become hard under cold winter temperatures and then present difficulties when applying the preparation or, respectively, cosmetic. In addition, the necessity of providing cosmetics in a shape-stable form means certain restrictions in view of their composition.

Therefore, an object of the present invention is to provide an improved cosmetics container with which the aforementioned difficulties are overcome. A more specific object is to provide a cosmetics container which contains the contents in a less temperature-sensitive consistency for consistence unproblematic application.

SUMMARY OF THE INVENTION

The objects are successfully achieved with a cosmetics container of the species initially cited including an improvement wherein the preparation is provided as a pumpable fluid having a pasty to viscous consistency. The container is fashioned as a dispenser with a push button actuation element, a dispenser valve, and a skin contact member with an application surface that can preferably be shaped like a round plate, like a tear drop or elliptically.

The pasty to viscous consistency of the preparation advantageously permits storage and, independently of temperature influences, facilitates controlled discharge from the dispenser dosed in a desired amount onto the application surface of the skin contact member for unproblematically application to the skin.

In order to facilitate this application procedure, a preferred embodiment provides that the skin contact member is arranged in a plane slanting relative to the longitudinal axis of the housing.

Specifically, an embodiment of the cosmetics container includes a housing coverable with a cap, the housing forming a reservoir to protectively contain the pumpable fluidic preparation. A skin contact member including a dispenser cap is secured to the housing, and is generally cylindrical in shape, similar to the shape of a traditional solid lipstick. A top of the skin contact member has a plate-like application surface. In one embodiment, a push-button actuation element is mounted in the skin contact member. Movement of the actuation element is operable to pump or displace the preparation from the reservoir toward said application surface. A dispenser valve is located in the skin contact member to dispense an amount of the pumped preparation to the application surface, so that the preparation may be spread onto the skin. Preferably, the application surface is disposed in a plane which is slanted relative to a longitudinal axis (x—x) of the housing. Moreover, the application surface is preferably flat, and may be shaped plate-like, round teardrop-like or elliptical.

In an embodiment, the dispenser valve includes a moveable flat valve disk located at a top of the skin contact member. The valve disk has a peripheral edge which is engageable against a corresponding edge of the skin contact member to open or close flow of said preparation to the application surface, although the valve disk is preferably biased in a closed position by a restoring force. Moreover, the valve disk is connected to a stem-like mounting element which extends away from the application surface along the axis, and which is snap-fit relative to the skin contact member.

To facilitate pumping of the preparation fluid, the container includes a nozzle at a top of the reservoir. A check valve is located in the nozzle to permit one-way flow of the fluid preparation from the reservoir through the nozzle. A resilient displacement member forms a preparation delivery channel between the nozzle and the dispenser valve. The displacement member provides a bladder effect. When the elastic displacement member is squeezed or deformed, the check valve prevents fluid in the displacement member from flowing into the reservoir. Rather, the fluid is displaced upward toward the dispensing valve.

In the embodiment with the push-button actuation element, the actuation element is pressed against the displacement member cause this pumping action. In another embodiment, the container does not have a push-button actuation element, but the displacement member is accessible through an opening in the skin contact member so that it may be manually pressed and deformed by a user's finger.

In order to maximize withdrawal of the fluid, an embodiment of the invention provides a piston movably disposed in said reservoir. The piston is drawn upwardly in the reservoir by vacuum pressure as the preparation is pumped. The piston has a piston head facing said wall. The piston head and wall preferably have respective correspondingly complementary shapes, so that minimal void space is formed between these components when the piston is against the wall.

To permit filling of the reservoir, in an embodiment, a floor element may be mounted to the housing with a snap-fit to permit filling the reservoir from a bottom of the housing. This filling may be done during initial manufacturing or at a subsequent refilling.

The mounting element includes a stem connected to said valve disk and a lower head part which is radially wider than the stem. This lower head part provides a snap-fit into an upper region of the displacement member. The mounting element has a cross-sectional shape permitting flow of the preparation from said displacement member to said valve disk. For instance, the stem and head part may be X-shaped.

Additional features and advantages of the present invention are described in, and will be apparent from, the detailed description of the preferred embodiments, and from the drawings.

BRIEF DESCRIPTION OF THE DRAWINGS

The invention is illustrated in schematic drawings in a preferred embodiment as lipstick, whereby further advantageous details of the invention may be derived from the drawings.

Shown are.

DETAILED DESCRIPTION OF THE PREFERRED EMBODIMENTS

Figure 1:
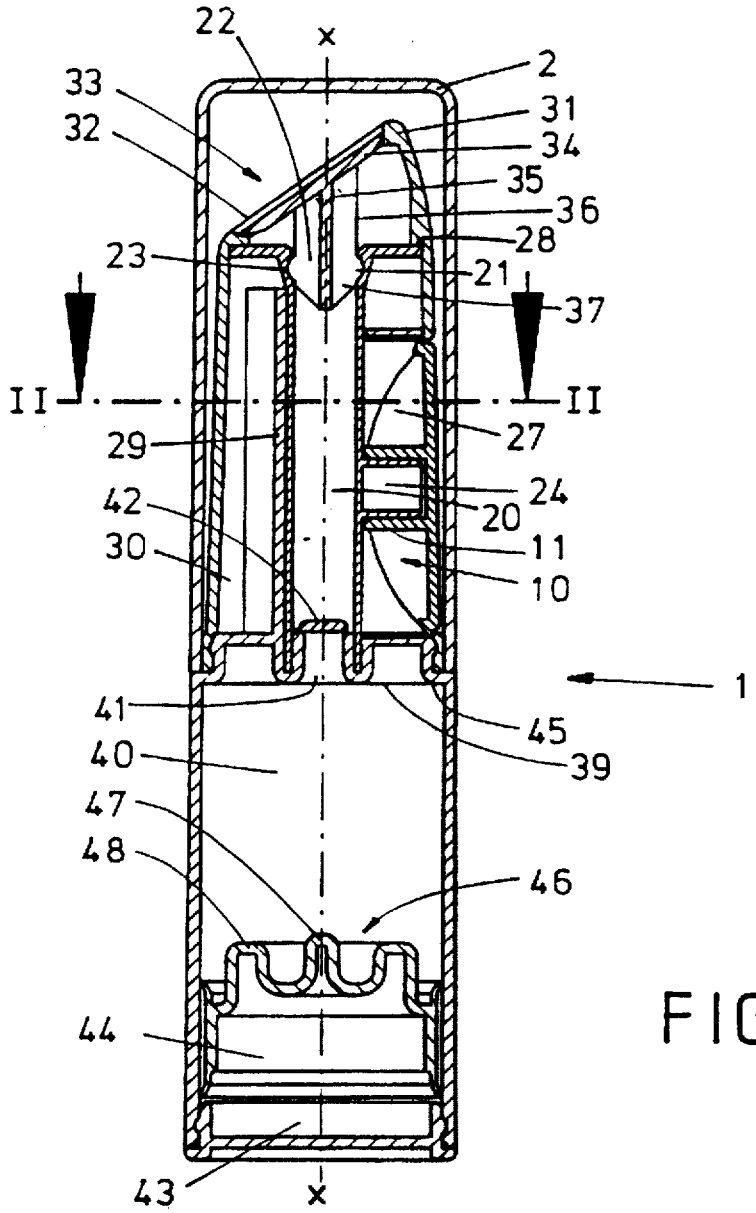
FIG. 1 a longitudinal section through the cosmetics container along a plane of section placed through the center axis (x—x)

The cosmetics container shown in FIG. 1, a lipstick in this example, is fashioned as a dispenser having a housing (1) with a push button actuation element (10). The dispenser includes a flat skin contact member (31) with an application surface (32) at its discharger side as well as with a plate-shaped dispenser valve (33).

For facilitating application of the make-up, the skin contact member (31) is arranged in a plane slanted relative to a longitudinal axis (x—x) of the housing (1). The valve (33) includes the skin contact member (31) of elastic thermoplastic material arranged in the slanting plane that can be closed with a flat valve disk (34) under a restoring force. The valve disk (34) is fashioned with a mounting element (35) aligned on the axis (x—x) of the housing (1). The mounting element (35) can be clipped into the end of the dispenser (30) at the discharge side. Assembly of the dispenser valve (33) is thereby significantly simplified. The application surface (32) of the skin contact member (31) can be circular or shaped like a tear drop or can also comprise some other shape, for example elliptical. As a result of fashioning the valve (33) with the valve disk (34) that seals an edge of the skin contact member (31), a slight, dosable amount of make-up emerges as desired from the edge of the application surface (32) thereonto and can be readily distributed thereon and applied onto the lips.

An embodiment of the cosmetics container includes a reservoir (40) for the preparation that can be filled from the bottom. Leading from the reservoir, is a centrally arranged delivery nozzle (41) at the discharge side that can be closed with a swing-type check valve (42) in a direction opposite the discharge. A piston (44) is movably received in a lower region of the housing which is closable with a snap-in floor element (43). The reservoir (40) can be shaped circular, oval, polygonal or the like in crossection. The reservoir (40), the snap-in floor element (43) and the piston (44) are uncomplicated in structure, rugged and compact and enable both a cost-beneficial manufacture and assembly of the parts as well as an unproblematical filling of the reservoir (40). This structure also enables a refilling of the lipstick liquid or paste substance after being emptied of its contents.

The reservoir (40) includes an upper, peripherally graduated shoulder (45) that is received in a dispenser cap (30). In its central region, this dispenser cap has an elastic displacement member (20) emplaceable on the delivery nozzle (41) of the reservoir (40). The push button (10) is laterally arranged in the dispenser cap (30) to press inwardly against the elastic displacement member (20), reducing its interior volume to cause displacement of its pasty or viscous contents in the direction of the valve (33).

An embodiment further provides that the mounting element (35) is fashioned with a stem (36) leaving passages free in the crossection and with a thickened, lower head part (37) for snapping into the upper region of the displacement member (20). The displacement member (20) is thereby an elastically fashioned hose with restoring force of its shape that lies against a supporting element (29) at one long side and can be charged with the push button actuation element (10) at the opposite long side. This arrangement makes it possible to have small and extremely small portions of the preparation emerge dosed as desired at the dispenser valve (33) as needed.

A further embodiment provides that the end of the displacement member (20) at the discharge side includes a peripheral supporting flange (21) that engages under a shoulder (28) fashioned in the dispenser cap (30) under the skin contact member (31). Also, the dispenser cap (30) is fashioned with a conically expanding central opening (22) that comprises an inner, shallow annular channel (23) for snapping in the head part (37) fashioned at the stem (36) of the valve disk (34).

It is provided according to an expedient embodiment that the push button actuation element (10) is an element arranged in an outer recess (27) of the dispenser cap (30) that terminates flush with the outer contour of the dispenser cap (30) on all sides in idle position and that has a cylindrical plug-on projection (11) directed against the displacement member. The displacement member (20) includes a plug-on lateral extension (24) projecting radially toward the center axis (x—x) to receive the button (11) in a coupled, plug-on manner. This fashioning not only yields an advantageously uncomplicated manipulation of the lipstick but also enables an uncomplicated and, potentially, fully automated, cost-beneficial assembly.

It is also provided in an expedient embodiment that the head part (46) of the piston (44) is shaped with a central plug (47) and an annular bead (48) compatibly adapted to the shaping of a top wall (39) of the reservoir (40) at its discharge side. This shaping assures that the contents of the reservoir can be practically completely emptied.

The cosmetics container can be manufactured of a variety of thermoplastic materials and, in particular, the displacement member (20) as well as the valve (33) and the piston (44) are composed of a plastic grade that characterized by greater elasticity than the plastic grade of the other elements.

Figure 2:
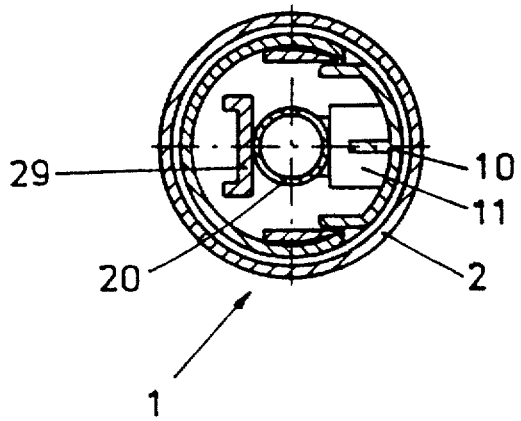
FIG. 2 a crossection of the lipstick according to the plane of section II—II in FIG. 1.
Figure 3:
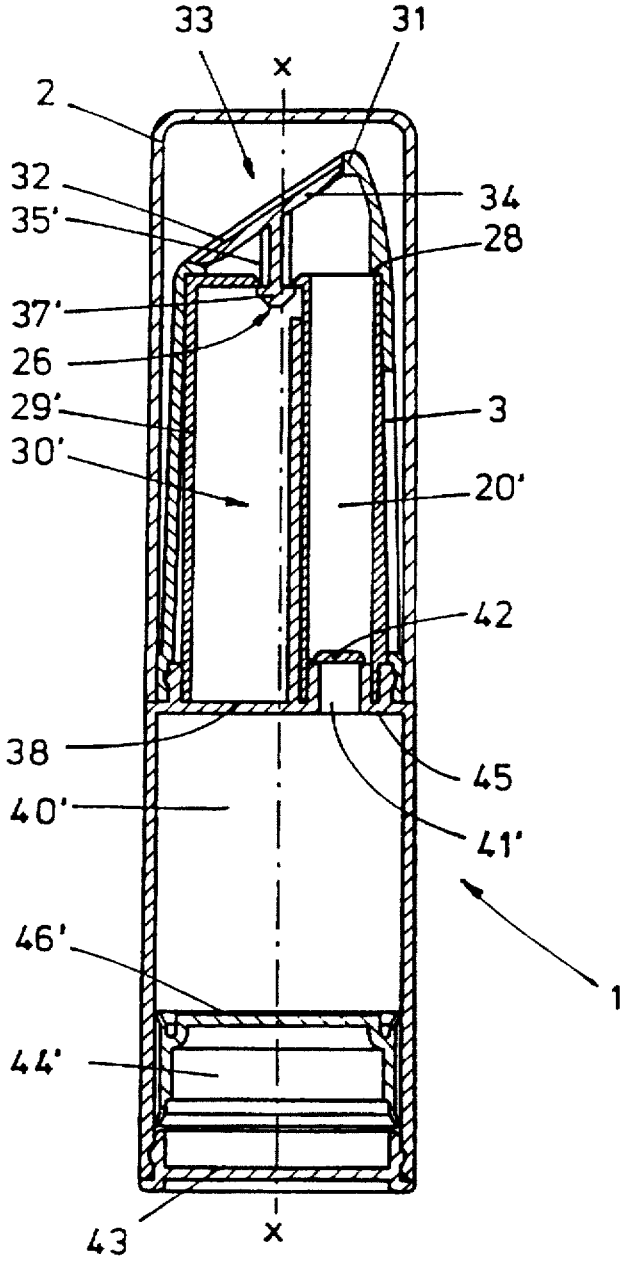
FIG. 3 a longitudinal section through another embodiment of the lipstick.

FIG. 3 shows another, especially simplified embodiment of the lipstick. For greater clarity compared to the embodiment of FIGS. 1 and 2, elements that are modified and/or differently arranged are indicated therein with reference numerals provided with a prime. In this embodiment of the lipstick fashioned as dispenser, the displacement member (20') simultaneously serves as actuation element since, due to the provision of a window were opening (3) in the housing (1) of the dispenser cap (30'), it can be directly charged by hand without intervention of a push button, for example with the thumb.

Like the embodiment according to FIGS. 1 and 2, the lipstick has a flat skin contact member (31) with an application surface (32) as well as a plate-shaped dispenser valve (33). The valve (33) likewise further comprises a flat valve disk (34) in the skin contact member (31) arranged in the slanted plane relative to (x—x), whereby the valve disk (34) is fashioned with a somewhat eccentrically arranged holder element (35') and an arrow-shaped head (37') thereof that can be snapped into an opening (26) of a supporting member (29') is held by overlapping edges of the opening (26).

The lipstick has a cylindrical reservoir (40') fillable from below with an upper, flat closure wall (38) with a laterally off set delivery nozzle (41'). The supporting element (29') against which the hose-shaped displacement member (20') is supported in which is likewise a laterally displaced arrangement is located in a lateral arrangement at the closure wall (38) and clamped between this and the shoulder (28) of the dispenser cap (30'). As a result thereof, the displacement member (20') lies directly against the housing opening (3) from the inside and can be charged by hand as actuation element for dispensing make-up.

A simplification of the embodiment of the cosmetics container is also achieved by providing a piston (44') having a flat head part (46') that, toward the end of the emptying of the reservoir (40'), places itself against what is the likewise flat underside of the upper closure wall (38) and, consequently, enables a nearly complete emptying of the content of make-up compound. The simplified shaping of piston floor (46') and closure wall (38) also enables the employment of simple and, thus, cost-beneficial manufacturing tools.

The lateral displacement of the displacement member (20') advantageously results therein that the make-up need not be conducted through at the stem (36') of the holder element (35') but freely emerges under the valve disk (34) into the space formed thereunder. The possibility thereby also devices that the displacement member (20') can forego the fashioning with a flange at the discharge side and can be fashioned in the uncomplicated form of a hose section that can be supported at the top against the shoulder (28) of the dispenser cap (30').

The selection made with respect to the manufacturing material for the lipsticks of FIGS. 1 and 2 also applies to the lipstick of FIG. 3. Coinciding with the exemplary embodiment of FIG. 1, this, moreover, comprises a shoulder (45) for plug-on of the dispenser cap (30') and a floor element (43) for the downward termination of the reservoir (40').

As the exemplary embodiments of FIGS. 1 through 3 show, a person skilled in the art can, within the scope of the inventive fashioning of the lipstick, select varied embodiments deviating slightly from one another that, in particular, optimally correspond to the respective production conditions.

Various changes and modifications to the presently preferred embodiments will be apparent to those skilled in the art. Such changes and modifications may be made without departing from the spirit and scope of the present invention. For example, the components could have different shapes, or some of the parts could be made of metal, instead of plastic. Therefore, the appended claims are intended to cover such changes and modifications.

What is claimed is:

1. A cosmetics container comprising:

a housing coverable with a cap, the housing configured to protectively contain a pasty to viscous preparation for application to the skin;

a skin contact member of elastic thermoplastic material secured to said housing, the skin contact member having a flat application surface;

an actuation element mounted in the skin contact member, said actuation element operable to cause a displacement of the preparation toward said application surface; and a dispenser valve operable to dispense to said application surface an amount of preparation delivered by said actuation element, the application surface disposed in a plane which is slanted relative to a longitudinal axis of the housing.

2. The cosmetics container according to claim 1, wherein the dispenser valve comprises:

the skin contact member of elastic thermoplastic material; and a moveable flat valve disk having a peripheral edge engageable against an edge of said skin contact member to open and close flow of said preparation to the application surface, the valve disk being biased in a closed position and connected to a mounting element extending away from the application surface along the axis of the housing, the mounting element being snap-fit relative to the skin contact member.

3. The cosmetics container according to claim 1, wherein the housing forms a reservoir for containing the preparation, and wherein the container further comprises:

a centrally arranged nozzle at a top of said reservoir;

a check valve located in the nozzle to permit one-way flow of said preparation from said reservoir through said nozzle;

a piston movably disposed in said reservoir;

a floor element mounted to the housing with a snap-fit to permit filling the reservoir from a bottom of the housing;

an upper, peripherally graduated shoulder of the housing onto which said skin contact member is secured;

an elastic displacement member forming a preparation delivery channel between said nozzle and said dispenser valve, said elastic displacement member being elastically deformable by said actuating element.

4. The cosmetics container according to claim 3, wherein said mounting element includes:

a stem connected to said valve disk; and a lower head part radially wider than said stem, said lower head part being snap-fit into the displacement member, the mounting element having a cross-sectional shape permitting flow of the preparation from said displacement member to said valve disk.

5. The cosmetics container according to claim 3, wherein the displacement member is an elastic hose which resiliently restores a shape of said hose; the dispenser further comprising a rigid supporting element extending along a side of the displacement member opposite said actuating element.

6. The cosmetics container according to claim 4, wherein an upper portion of the displacement member includes a peripheral supporting flange that engages under a shoulder formed in the skin contact member and wherein the displacement member includes a conically expanding central opening having an inner, shallow annular channel to receive the head part of the stem of the valve disk.

7. The cosmetics container according to claim 3, wherein the actuation element is arranged in an opening of the skin contact member, the actuating element including a button having a shape which, when the button is in a normal position, is flush with an outer contour of the skin contact member, the button having a plug-on projection directed toward the displacement member, the displacement member including a plug-on extension projecting radially away from the center axis, the plug-on extension of the displacement member being securably received in the plug-on projection of the button.

8. The cosmetics container according to claim 3, wherein the reservoir has an upper wall containing the nozzle, and wherein said piston has a piston head which faces said wall, the piston head and wall having respective correspondingly complementary shapes.

9. The cosmetics container according to claim 3, which is made of thermoplastic plastics and wherein the displacement member, the valve, and the piston are made of a plastic having greater elasticity than the other elements.

10. A cosmetics container according to claim 1, wherein the application surface is generally flat and shaped one of round, teardrop and elliptical.

11. A cosmetics container according to claim 8, wherein the piston head has a central plug and an annular bead which extend toward said upper wall, the central plug being received in the nozzle.

12. A cosmetics container comprising:

a housing coverable with a cap, the housing including a reservoir to protectively contain a pasty to viscous preparation for application to the skin;

a skin contact member of elastic thermoplastic material secured to said housing, the skin contact member having a flat application surface;

a resiliently deformable displacement member forming a channel from said reservoir toward said application surface;

a check valve permitting one-way flow of the preparation from the reservoir through the displacement member;

a dispenser valve receiving preparation from the displacement member, the dispenser valve operable to dispense the preparation to said application surface, the application surface disposed in a plane which is slanted relative to a longitudinal axle of the housing; and an opening in the skin contact member adjacent the displacement member, the opening providing access to permit manual deformation of the displacement member.

13. The cosmetics container according to claim 12, wherein the displacement member and support member are laterally offset relative to said longitudinal axis, the cosmetics container further comprising:

a shoulder in the skin contact member supporting a top of the displacement member.

14. The cosmetics container according to claim 13, wherein the dispenser valve comprises:

a moveable flat valve disk having a peripheral edge engageable against an edge of said skin contact member to open and close flow of said preparation to the application surface, the valve disk being biased in a closed position;

a mounting element extending away from the application surface along the axis of the housing, the mounting element being snap-fit relative to said skin contact member.

15. The cosmetics container according to claim 14, wherein said mounting element includes:

a stem connected to said valve disk; and a lower head part which is radially wider than said stem;

wherein the supporting member is held between an upper wall of the reservoir and the shoulder, the supporting member including a passage at its upper side to receive said lower head part in a snap-fit manner.

* * * * *